United States Patent [19]

Fritz

[11] Patent Number: 4,859,205

[45] Date of Patent: Aug. 22, 1989

[54] STRAIN RELIEF FOR FLAT CABLE TERMINATION

[75] Inventor: William B. Fritz, Hummelstown, Pa.

[73] Assignee: AMP Incorporated, Harrisburg, Pa.

[21] Appl. No.: 194,063

[22] Filed: May 13, 1988

[51] Int. Cl.[4] ..... H01R 9/07

[52] U.S. Cl. ..... 439/492; 439/393; 439/410; 439/422

[58] Field of Search ..... 439/445, 446, 447, 452, 439/470, 492–499, 422, 430, 442, 877, 607–610, 471, 393, 410, 409

[56] References Cited

U.S. PATENT DOCUMENTS

| | | | |
|---|---|---|---|
| 3,247,316 | 4/1966 | Weimer, Jr. . | |
| 3,599,173 | 8/1971 | Bridle | 439/422 |
| 3,851,294 | 11/1974 | Palazzetti et al. | 439/493 |
| 3,854,787 | 12/1974 | Snyder, Jr. . | |
| 4,285,561 | 8/1981 | Chow | 439/422 |
| 4,352,531 | 10/1982 | Gutter . | |
| 4,371,225 | 2/1983 | Narozny . | |
| 4,451,099 | 5/1984 | Bricker, Jr. et al. | 439/497 |
| 4,451,099 | 5/1984 | Bricker, Jr. et al. . | |
| 4,457,576 | 7/1984 | Cosmos et al. | 439/610 |
| 4,772,212 | 9/1988 | Sotolongo | 439/497 |
| 4,773,878 | 9/1988 | Hansell, III | 439/610 |

FOREIGN PATENT DOCUMENTS

| | | |
|---|---|---|
| 7239900 | 10/1907 | Fed. Rep. of Germany . |
| 2228780 | 1/1974 | Fed. Rep. of Germany . |

OTHER PUBLICATIONS

AMP Termi-Foil Terminals and Splices; Data Sheet 74–279; issued 7–84.

*Primary Examiner*—David Pirlot
*Attorney, Agent, or Firm*—Anton P. Ness

[57] ABSTRACT

Relief against torque for a terminal terminated to an end portion of a flat conductor cable is provided by a low height rearward section of a metal member having opposed sections forwardly of a cable-receiving end having a transverse cable-receiving slot. The cable end is inserted through the slot for termination forwardly of the cable-receiving end and disposed between the opposed sections. The opposed sections are joined together by a pair of integral spaced bight straps or hinge sections beside the cable at the ends of the slot. The straps or hinges enable the metal member to resist torque applied to the termination by the cable. The metal member can be the terminal itself, a transition adapter for termination to flat electrical cable of the type having opposed plate sections applied to the major cable surfaces which include means for mechanical and electrical connections therewith. A pair of elongate flanges can extend along the sides of the slot and outwardly away from the major cable surfaces to provide strength ribs to prevent torque from the cable from prying apart the plate sections of the adapter after termination.

6 Claims, 4 Drawing Sheets

STRAIN RELIEF FOR FLAT CABLE TERMINATION

FIELD OF THE INVENTION

The invention relates to electrical connections and more particularly to connections of terminals to flat cable.

BACKGROUND OF THE INVENTION

U.S. Ser. No. 07/050,793 discloses a transition adapter which is secured onto a flat power cable by being crimped thereto, and the adapter includes one or more contact sections to be engaged with corresponding contacts of an electrical connector to transmit power current from the cable to the connector. The cable is of the type entering commercial use for transmitting electrical power of for example 75 amperes nominal, and includes a flat conductor one inch wide and about 0.020 inches thick with an extruded insulated coating of about 0.004–8 inches thick over each surface with the cable having a total thickness averaging about 0.034 inches. The metal of the flat conductor is for example of Copper Alloy 110 and the insulation is for example TEFZEL thermoplastic resin known as polyethylene-co-tetrafluoro-ethylene copolymer (trademark of the E. I. DuPont de Nemours and Company, Wilmington, Del.).

The transition adapter of Ser. No. 07/050,793 includes a pair of plate sections hinged together at the forward or terminal end of the adapter, and a still-insulated end or edge portion of the cable is to be crimped therebetween. At a selected location forwardly of the cable-crimping region at least one of the plate sections is bent at an angle away from the other so that the plate sections are facing each other at an angle and are thus spaced apart to receive the cable end or edge therebetween. A plurality of lances extend from one plate section toward corresponding apertures in the other so that upon pressing the plate sections together the lances penetrate through the cable. The lances are then received through the apertures and the ends thereof are bent over and against the outer surface of the other plate section, being bent over by tool means or by integral arcuate guides at each aperture. By penetrating the cable a plurality of electrical connections are formed between the adapter and sheared conductor edges of the cable. By being stamped from sheet metal of an appropriate alloy, the lances are preferably defined by shear edges and penetrate through the insulation and also the conductor of the cable in cooperation with the lance-receiving apertures which preferably include at least one shear edge against which the cable is pressed during penetration by the lances. Additional electrical connections are made by a plurality of barbs which penetrate the cable insulation to engage and bite into the cable conductor.

U.S. patent application Ser. No. 07/193,458 (AMP filed May 13, 1988 and assigned to the assignee hereof, discloses another transition adapter for terminating flat power cable. Opposed plate sections have opposed cooperating terminating regions comprised of a plurality of alternating wave shapes and relief recesses, with each wave shape aligned with a recess of the opposing terminating region. When the plate sections are urged together under sufficient force, shearing edges along each side of each wave shape shear the cable conductor by cooperating with shearing edges of the adjacent wave shapes of the opposing terminating region, scissors-fashion. Crests of the wave shapes deflect the sheared cable portions into the opposing relief recesses, forming a series of interlocking wave joints across the intermeshing terminating regions and terminating the cable between the plate sections. The wave crests deflect integral strips of conductor out of the plane of the cable, exposing sheared conductor edges to be electrically connected such as with solder or with surfaces of soft copper members secured to outer surfaces of the plate sections and held against the exposed conductor edges by being staked to create stored energy for gas-tight electrical connections.

It is desired to provide terminals terminated to an end of a flat cable with means to resist torque applied to the termination by strain on the flat cable, and thus protect the termination from adverse effects.

It is further desirable to provide such a strain relief integral with the terminal.

SUMMARY OF THE INVENTION

The present invention is a system for relief against torque for a terminal terminated to an end portion of a flat conductor cable. The relief is provided by a low height rearward section of a metal member having opposed sections forwardly of a cable-receiving end having a transverse cable-receiving slot. The cable end is inserted through the slot for termination forwardly of the cable-receiving end and disposed between the opposed sections. The opposed sections are joined together by a pair of integral spaced bight straps beside the cable at the ends of the slot. The straps enable the metal member to resist torque applied to the termination by the cable.

In one embodiment of the invention, the metal member is the terminal itself, transition adapter for flat cable where the adapter comprises at least a stamped and formed member having opposed plate sections integrally joined at a cable-receiving end by a hinge. The hinge comprises two sections spaced apart transversely a distance wide enough to define a slot for an end portion of the flat cable to be inserted therethrough and disposed between the hinge sections. The slot is stamped into the metal blank from which the adapter is formed, and preferably the metal comprising the region to become the slot is slit transversely and also axially across ends of the transverse slit so that the metal can be bent out of the plane of the blank to define a pair of transverse flanges. The flanges comprise strength ribs in the adapter extending outwardly above and below the resultant slot and between the hinge sections, and the flanges enable the adapter to resist torque applied to the adapter by the cable at ends of the slot, to prevent the tendency for such torque to pry apart the plate sections of the adapter from each other and from the joints with the cable, and thus to protect the integrity of the termination.

It is an object of the invention to provide relief against cable torque to protect the electrical connections of a terminal terminated to the end of a flat cable, by a low height metal member secured to the terminated cable end.

It is an object of the invention to provide a transition adapter with integral means to resist torque from prying the plate sections apart and thus to relieve and protect the termination.

An embodiment of the present invention will now be discussed with reference to the accompanying drawings in which:

DETAILED DESCRIPTION OF THE PREFERRED EMBODIMENT

Figure 1:
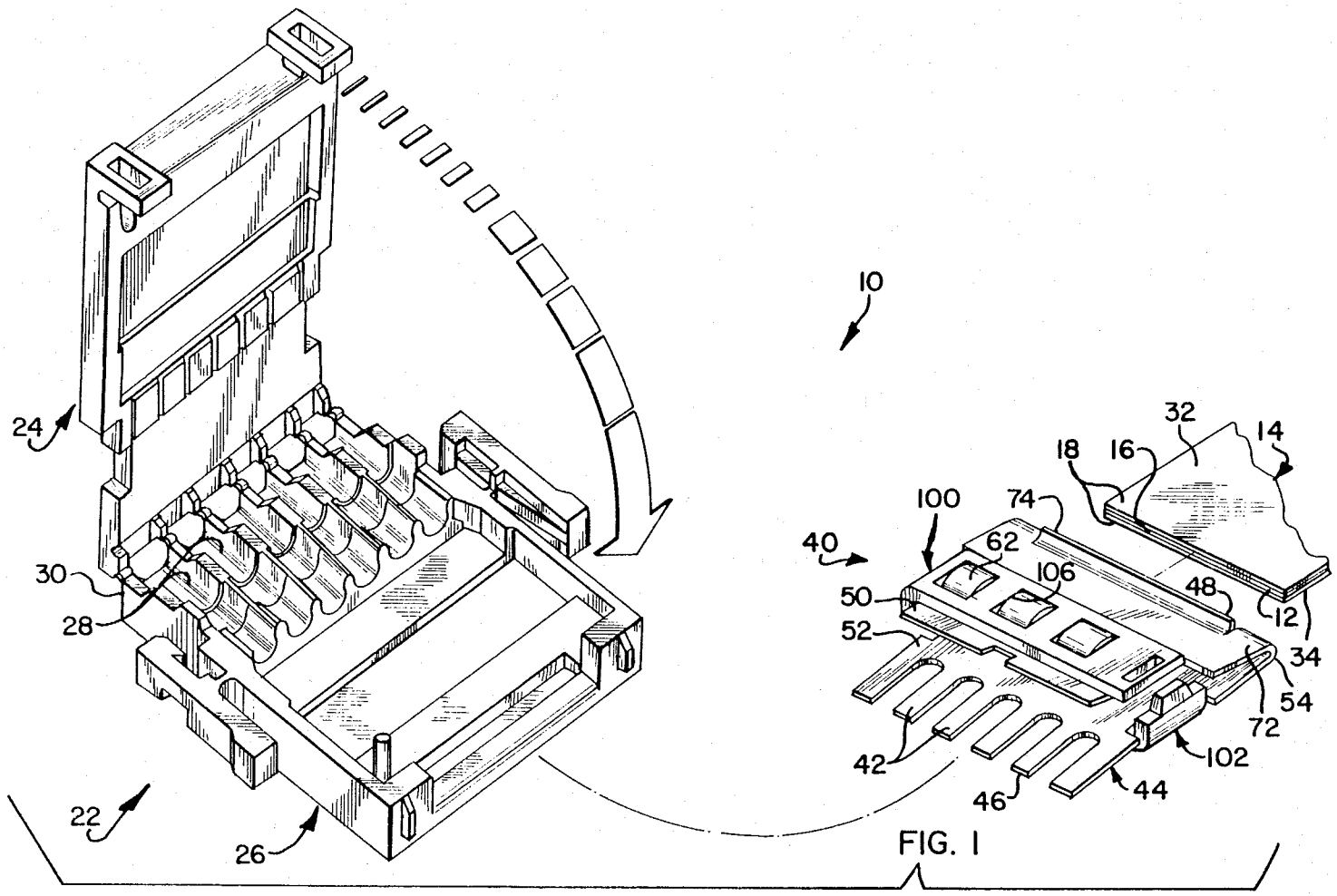
FIG. 1 illustrates an electrical connector for flat power cable utilizing the strain relief of the present invention.

FIG. 1 illustrates a connector assembly 10 in which a transition adapter 40 is used to terminate an end 12 of flat power cable 14 for a power distribution system for within electronic devices such as computers, copying machines and the like, and also for card cage systems such as that disclosed in U.S. patent application Ser. No. 07/127,992 filed Dec. 2, 1987 and assigned to the assignee hereof. Cable 14 is of the type comprising a flat conductor 16 such as 0.020 inches thick copper or aluminum with an insulative coating 18 extruded therearound, such as four to eight mils thickness of TEFZEL thermoplastic resin (trademark of E. I. DuPont de Nemours and Company) along each surface. After application of transition adapter 40 onto cable end 12, the terminated end is secured within a dielectric housing assembly 22 comprising first and second cover members 24,26 for example. Cover members 24,26 can be hinged to facilitate being rotated together and latched to enclose the terminated cable end. Passageways 28 extend inward from mating face 30 to contain the contact sections of the adapter for mating to corresponding contacts (not shown). The housing assembly can be configured in accordance with the type of contact section or sections 42 desired to be formed on the adapter 40, and also the particular use to which the connector is to be put.

Figure 2:
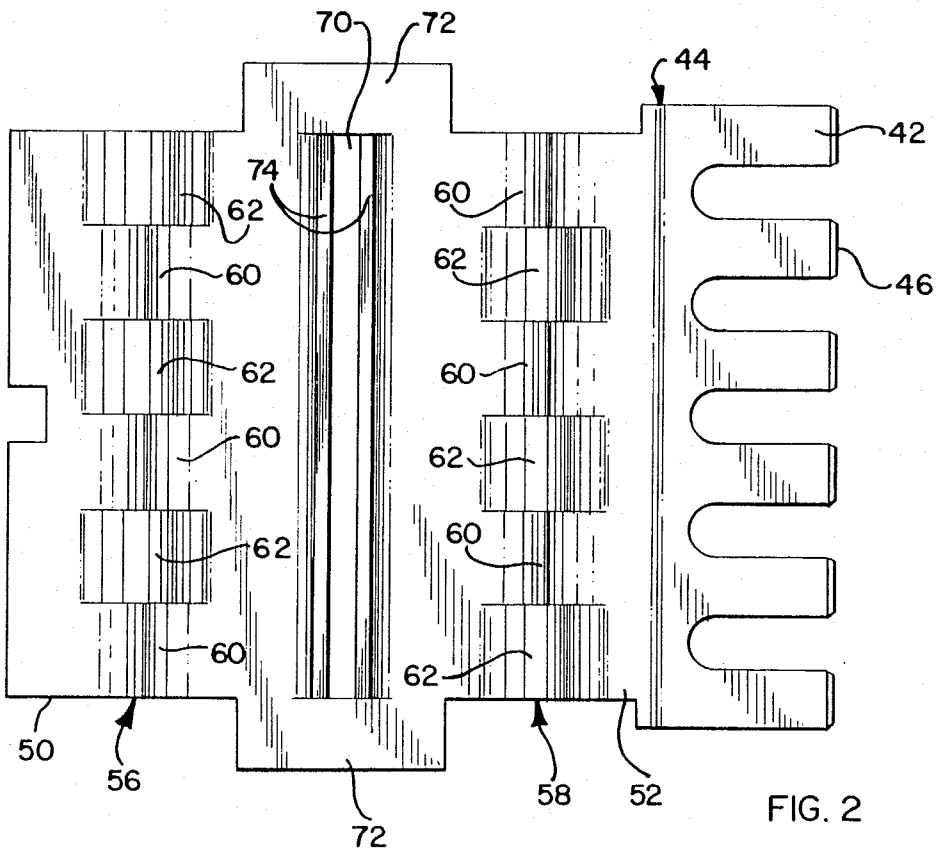
FIG. 2 is a plan view of the body member of the adapter of FIG. 1 prior to its plate sections being bent back along each other, showing the present invention.

Transition adapter 40 is described more particularly in Ser. No. 07/193,458 and includes at least a body member 44 to which the one or more contact sections 42 are joined or are an integral part, at mating end 46. Body member 44 also includes a cable-receiving end 48 which may be at the opposite end from mating end 46. Body member 44 also includes a pair of plate sections 50,52 preferably integrally joined at hinge 54 so that the plate sections after termination will be disposed in parallel along opposed major side surfaces of cable end 12 and clamped onto cable 14. Plate sections 50,52 forwardly of the rearward section have respective terminating regions 56,58 extending transversely thereacross, each comprising a row of spaced wave shapes 60 as seen in FIG. 2. Wave shapes 60 alternate with relief recesses formed by arcuate relief shapes 62, and each of the wave shapes of each of the plate sections is located opposed from an arcuate relief shape of the other of the plate sections.

When the adapter has been bent at hinge 54 into a form ready to be terminated onto a cable end, the wave shapes of each plate section will extend outwardly of the cable-proximate surface 64 thereof and toward the other plate section to radiussed crests 66 (FIG. 3A); the arcuate relief shapes 62 will extend outwardly of cable-remote surface 68 thereof and away from the other plate section. Essentially wave shapes 60 of each of plate sections 50,52 present a cooperating pattern with wave shapes 60 of the other which are offset, and the wave shapes would intermesh if the plate sections were to be urged against each other about hinge 54.

Referring to FIG. 1, preferably transition adapter 40 includes a pair of insert members 100,102 affixed to cable-remote surfaces 68 of respective plate sections 50,52 of body member 44 across terminating regions 56,58 thereof. Each insert member 100,102 has a pattern of wave shapes 104 alternating with relief apertures 106 likewise presenting a cooperating pattern with those of the other insert member after being secured appropriately to body member 44 such as by being staked as described more particularly in Ser. No. 07/193,458. After transition adapter 40 has been pressed onto cable end 12, wave shapes 104 are then staked to deform portions laterally and permanently against exposed conductor edges of cable 14.

In accordance with the present invention, torque relief is provided by a metal member having a rearward section comprising rearward portions of opposed sections associated with the major surfaces of the cable, such as plate sections 50, 52 of adapter 40, concluding at cable-receiving end 48. The rearward section has a spacing sufficient to receive a cable end therethrough, the spacing being at least equal to a cable thickness, and therefore the rearward section can have a low profile.

As shown in FIGS. 1 to 3C, the portion of the adapter which will become the cable-receiving end of the adapter has formed therein a slot 70 between integral straps of the blank which become a pair of bight straps or hinge sections 72. Placing integral hinges at the cable-receiving end helps resist the torque applied on the adapter by the relatively wide, relatively stiff cable. Preferably a pair of transverse tabs or flanges 74 are bent 90° about small radii out of the plane of the metal blank from which the adapter is formed, along both sides of elongated slot 70, thus actually creating the slot. Slot 70 is long enough and wide enough to receive therethrough the width and thickness of the particular flat cable 14 selected for termination by adapter 40, and the radiussed nature of the joint from which the flanges 74 extend respectively provides lead-in benefits facilitating cable insertion and won't damage the cable during handling and in-service use. Hinge sections 72 should be formed to have a radius about equal to one half of the cable thickness. Flanges 74 extend normally outwardly from the cable major surfaces 32,34 after termination and provide strength after termination to provide improved resistance to plate sections 50,52 being deflected apart resulting from torque which may be applied to the transition adapter due to stresses on the relatively wide, relatively stiff cable.

Body member 44 can be formed for example from strip stock of 0.025 inches thick copper alloy such as sold by Olin Corporation under Alloy No. 7025 half hard copper alloy, or such as Alloy No. 151 tempered hard alloy, Temper No. H05 with annealing for good stress relaxation properties. Insert members 100,102 can be formed for example of dead soft Copper CDA 110. Both the insert members and the body member can be silver plated, if desired, to assure the integrity of the electrical connection for long-term in-service use.

Figure 3A:
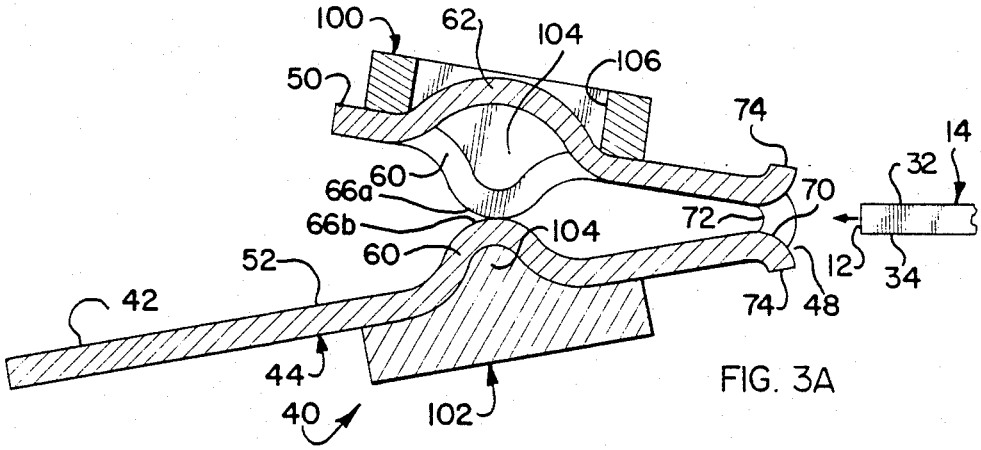
FIGS. 3A to 3C are longitudinal section views of the adapter of FIGS. 1 and 2 ready to receive a cable end thereinto, after receiving the cable end, and after being terminated thereonto respectively.
Figure 3B:
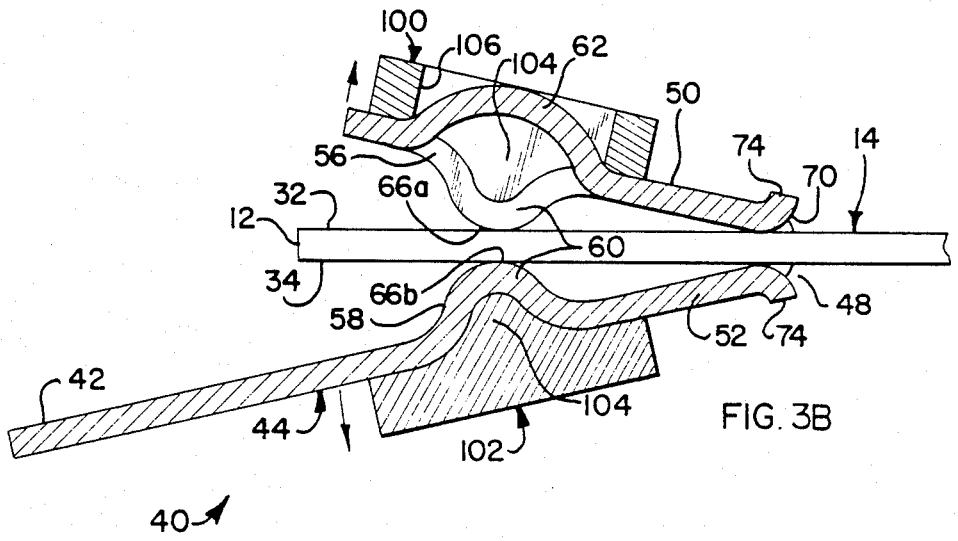
Figure 3C:
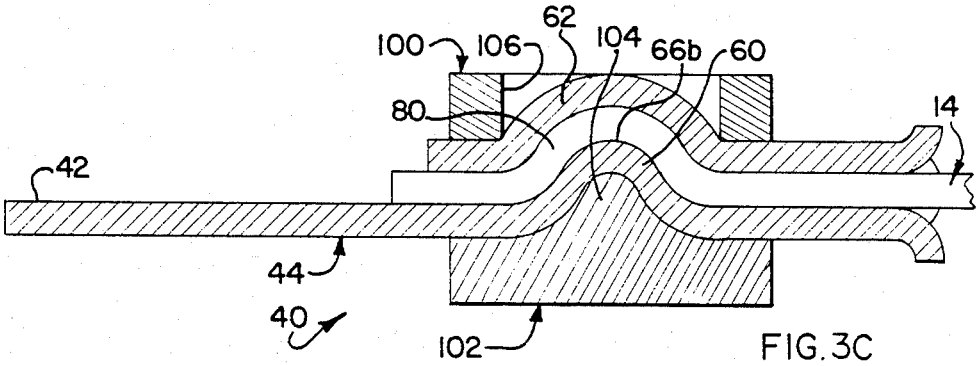
Figure 5:
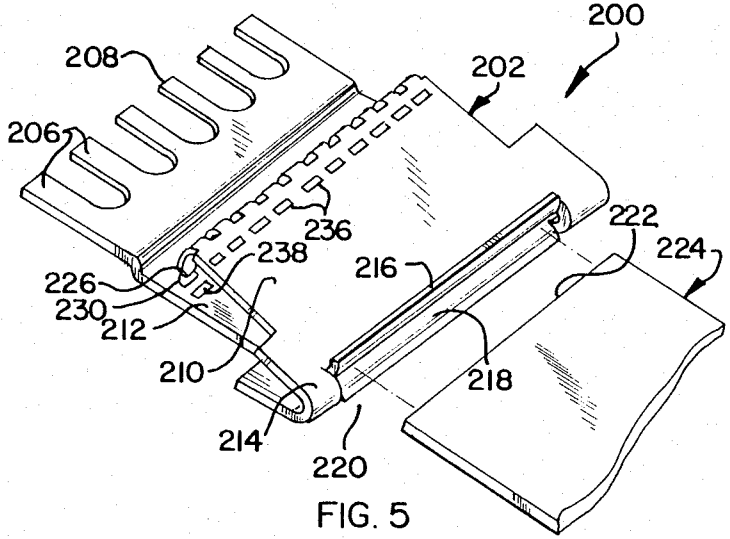
FIGS. 4 and 5 are a plan view similar to FIG. 2 and an isometric view respectively of a second type of adapter, showing the present invention.

In FIG. 3A the assembled transition adapter 40 is ready to receive cable end 12 into cable-receiving end 48, and wave shapes 60 are almost together at upper and lower crests *66a, 66b*. The cable end is inserted into slot 70 and deflects plate sections 50,52 apart in FIG. 3B and is moved forwardly until leading edge 12 is appropriately located a small distance in front of the terminating regions 56,58 but rearwardly of contact sections 42. Spring bias at hinge sections 72 creates a gripping of the cable by the crests *66a, 66b* against insulated upper and lower surfaces 32,34 of cable 14. In FIG. 3C the transition adapter 40 has been pressed together by tooling (not shown) such as an arbor press. Side edges of waves 60 comprising shearing edges have sheared the cable at a plurality of locations transversely across the cable, first puncturing and tearing the tough, ductile insulative coating 18 and then shearing the cable conductor 16 lengthwise for distances of about 0.25 inches while crests *66a, 66b* have deflected outwardly and elongated the thus sheared portions of cable conductor 16 forming alternatingly upward and downward arcuate conductor loops within the opposed arcuate relief shapes of the opposing plate section. At each wave shape 60 has been formed a wave joint 80, and transversely across the cable has been created a series of interlocking wave joints 80 comprising an assured mechanical joint of the transition adapter with the cable. When the insert members are subsequently staked such as by pointed chisel blades (not shown), side surfaces of relief apertures 106 thereof are pressed tightly and permanently against the exposed sheared conductor edges which have been deflected out of the plane of the cable by the wave crests *66a, 66b*. Preferably the wave joints 80 are first also staked by pointed chisel blades (not shown) to improve both the mechanical and electrical connections between the transition adapter and the cable.

A second embodiment of transition adapter 200 is shown in FIGS. 4 to 6B, and is of the general type disclosed in U.S. patent application Ser. No. 07/050,793. Adapter 200 is comprised of a body member 202 stamped and formed from a metal blank 204 (FIG. 4) and includes contact means such as contact sections 206 at mating end 208, and a pair of plate sections 210,212 integrally joined at a pair of laterally spaced hinge sections 214. Flanges 216 have been bent out of the blank between hinge sections 214 to define a slot 218. When body member 202 is bent at hinge sections about a radius equal to about one half a cable thickness, slot 218 and flanges 216 between hinge sections 214 will comprise a cable-receiving end 220 into which an end 222 of cable 224 can be inserted for termination.

Figure 6A:
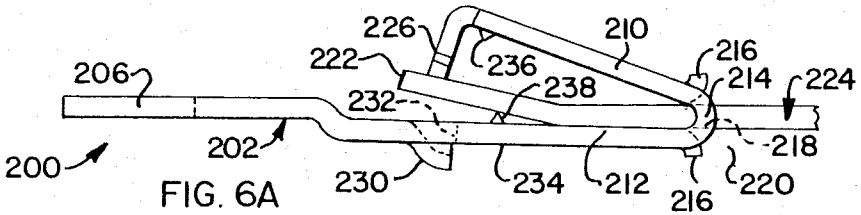
FIGS. 6A and 6B are elevation views of the adapter of FIGS. 4 and 5 receiving and being terminated to a cable end.
Figure 6B:
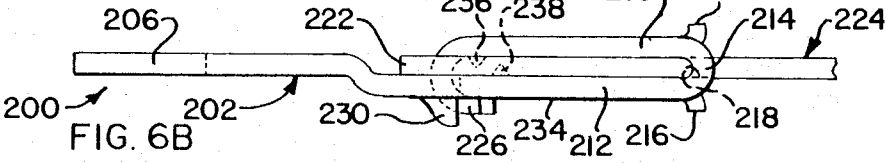
Figure 4:
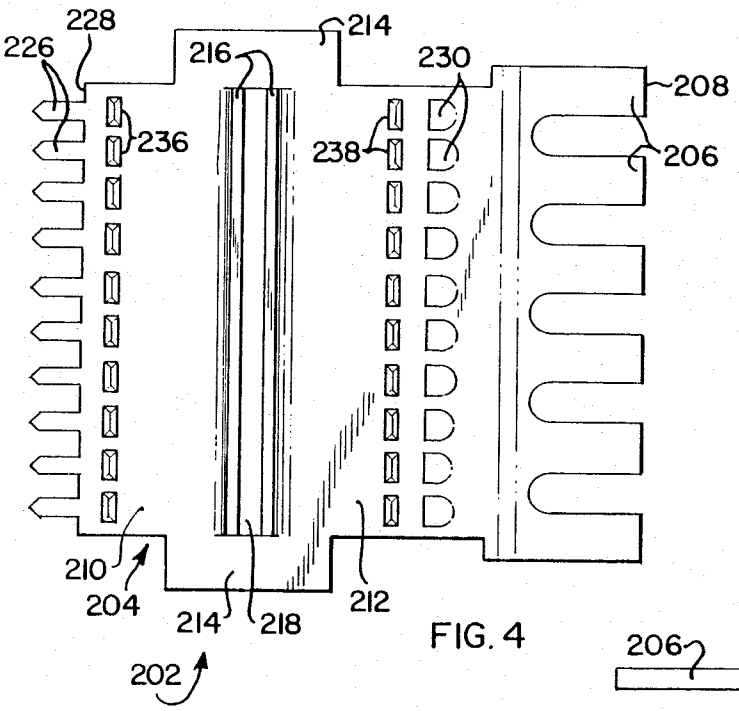

Plate section 210 includes a plurality of lances 226 extending from end edge 228 which are pointed and will penetrate through cable 224 to form a like plurality of mechanical and electrical connections therewith when plate sections 210,212 are pressed together against the major cable surfaces, as illustrated in FIGS. 6A and 6B. Plate section 212 includes a like plurality of arcuate guides 230 over apertures 232 created during the forming of arcuate guides 230 and corresponding to lances 226, and lances 226 will enter through apertures 232 during termination after penetrating the cable and will be curled around by arcuate guides 230 and against the outer surface 234 of plate section 212 to secure transition adapter 200 to cable 224. Preferably both plate sections 210,212 include a plurality of barbs 236,238 formed thereinto which will penetrate through the insulative covering of cable 224 and bite into the flat cable conductor to establish electrical connections with the conductor upon termination.

The hinge sections at the cable-receiving end of the adapter and the outwardly extending flanges provide a good strain relief mechanism which protects the termination of adapters to flat cable. Variations may be devised to the strain relief system of the present invention which are within the spirit of the invention and the scope of the claims.

What is claimed is:

1. A strain relief system for a terminal applied to end portions of flat electrical cable, the terminal being of the type having opposed plate sections affixed to major surface of the flat cable and including means for mechanical and electrical connections therewith, the strain relief system comprising:

an integral hinge means at a cable-receiving end of an electrical terminal joining opposed plate sections thereof, said hinge means comprising a pair of hinge sections spaced transversely apart, said terminal including a cable-receiving slot therebetween through which an end of a flat cable is insertable to be disposed between the plate sections of the terminal; and said terminal includes a pair of opposed flanges along said cable-receiving slot extending outwardly away from said major cable surfaces after termination, whereby the hinge sections and opposed flanges prevent torque applied on said terminal by said cable from tending to move said opposed sections apart and the mechanical and electrical connections of the termination are protected.

2. A strain relief system as set forth in claim 1 wherein said flanges each are joined to said terminal at said cable-receiving end by radiussed joints which provide lead-in benefits during cable insertion into said slot and provide non-sharp edges engageable by the cable after termination.

3. A strain relief member for a low profile termination of terminal means to an end portion of a flat conductor electrical cable, to provide relief against torque applied to the cable, the terminal means including means for electrical connection with flat conductor means of the electrical cable, the strain relief member comprising:

a metal member having a rearward section concluding in a cable-receiving end and defined by rearward portions of opposed sections coextending forwardly from said cable-receiving end and associated with respective major surfaces of a flat electrical cable, said opposed sections being joined by a pair of integral bight straps spaced laterally apart defining a cable receiving slot therebetween having a height about equal to a cable thickness, said opposed sections being spaced apart a distance about equal to a cable thickness and said rearward section thereby having a low profile of minimal height, an end of said flat electrical cable being insertable through said cable-receiving slot between said integral bight straps prior to termination of the terminal means to the cable end forwardly of said rearward section of said metal member, said opposed sections being securable together forwardly of said cable-receiving end and enclosing the cable end after cable insertion; and said metal member includes a pair of opposed flanges along said cable-receiving slot extending outwardly away from said major cable surfaces after termination, whereby after said opposed sections are secured together said integral bight straps and pair of opposed flanges prevent torque applied on the termination by the cable from tending to move said opposed sections apart and the electrical connection of the terminal means with the conductor means is protected at a location spaced rearwardly therefrom by low profile means.

4. A strain relief member as set forth in claim 3 wherein said metal member is stamped and formed from a metal blank.

5. A strain relief member as set forth in claim 4 wherein said flanges each are joined to said metal member at said cable-receiving end by radiused joints which provide lead-in benefits during cable insertion into said slot and provide non-sharp edges engageable by the cable after termination.

6. A low profile termination of terminal means to an end portion of a flat conductor electrical cable including relief against torque applied to the cable, the terminal means including means for electrical connection with flat conductor means of the electrical cable, the termination comprising:

a flat conductor electrical cable having an end portion to which terminal means are at least electrically connected; and a metal member having a rearward section concluding in a cable-receiving end and defined by rearward portions of opposed sections coextending forwardly from said cable-receiving end and associated with respective major surfaces of a flat electrical cable, said opposed sections being joined by a pair of integral bight straps spaced laterally apart defining a cable-receiving slot therebetween having a height about equal to a cable thickness, said opposed sections being spaced apart a distance about equal to a cable thickness and said rearward section thereby having a low profile of minimal height, and said metal member including a pair of opposed flanges along said cable-receiving slot extending outwardly away from said major cable surface after termination, an end of said flat electrical cable having been inserted through said cable-receiving slot between said integral bight straps prior to termination of the terminal means to the cable end forwardly of said rearward section of said metal member, said opposed sections having been secured together forwardly of said cable-receiving end and enclosing the cable end after cable insertion, whereby after said opposed sections are secured together said integral bight straps and opposed flanges prevent torque applied on the termination by the cable from tending to move said opposed sections apart, and the electrical connection of the terminal means with the conductor means is protected at a location spaced rearwardly therefrom by low profile means.

* * * * *

UNITED STATES PATENT OFFICE

CERTIFICATE OF CORRECTION

Patent No. 4,859,205 Dated August 22, 1989

Inventor(s) William B. Fritz

It is certified that error appears in the above-identified patent and that said Letters Patent is hereby corrected as shown below:

In column 6, line 20, claim 1, "surface" should be --surfaces--.

In column 8, line 16, claim 6, "surface" should be --surfaces--.

Signed and Sealed this

Twelfth Day of June, 1990

*Attest:*

HARRY F. MANBECK, JR.

*Attesting Officer*

*Commissioner of Patents and Trademarks*